US009180521B2

(12) United States Patent
Misawa et al.

(10) Patent No.: US 9,180,521 B2
(45) Date of Patent: Nov. 10, 2015

(54) METHOD FOR PRODUCING GRANULAR METALLIC IRON

(75) Inventors: Ryota Misawa, Kobe (JP); Sumito Hashimoto, Kobe (JP); Osamu Tsuge, Tokyo (JP)

(73) Assignee: Kobe Steel, Ltd., Kobe-shi (JP)

( * ) Notice: Subject to any disclaimer, the term of this patent is extended or adjusted under 35 U.S.C. 154(b) by 298 days.

(21) Appl. No.: 13/807,777

(22) PCT Filed: Aug. 26, 2011

(86) PCT No.: PCT/JP2011/069343

§ 371 (c)(1),
(2), (4) Date: Dec. 31, 2012

(87) PCT Pub. No.: WO2012/029670

PCT Pub. Date: Mar. 8, 2012

(65) Prior Publication Data

US 2013/0098204 A1 Apr. 25, 2013

(30) Foreign Application Priority Data

Aug. 30, 2010 (JP) ..... 2010-192343

(51) Int. Cl.
*C21B 13/08* (2006.01)
*C21B 13/10* (2006.01)
(Continued)

(52) U.S. Cl.
CPC ..... *B22F 9/30* (2013.01); *C21B 13/008* (2013.01); *C21B 13/0046* (2013.01);
(Continued)

(58) Field of Classification Search
None
See application file for complete search history.

(56) References Cited

U.S. PATENT DOCUMENTS 3,452,972 A 7/1969 Beggs
6,015,527 A * 1/2000 Kamei et al. ..... 266/145
(Continued)

FOREIGN PATENT DOCUMENTS

JP 2000 144223 5/2000
JP 2001 64710 3/2001
(Continued)

OTHER PUBLICATIONS

International Search Report Issued Dec. 6, 2011 in PCT/JP11/69343 Filed Aug. 26, 2011.

*Primary Examiner* — George Wyszomierski
(74) *Attorney, Agent, or Firm* — Oblon, McClelland, Maier & Neustadt, L.L.P.

(57) ABSTRACT

The present invention provides a method for producing a granular metallic iron in which an adhesion inhibitor leveler, an agglomerate leveler, a discharger, and the physical state of materials present on the hearth are optimized to thereby enable agglomerate to be spread in a single layer. The agglomerate hence is evenly heat-treated to enable high-quality granular metallic iron to be produced in satisfactory yield. The present invention relates to a method for producing a granular metallic iron, which comprises leveling an adhesion inhibitor fed to the hearth of a moving-bed type hearth reducing melting furnace, feeding an agglomerate including an iron oxide-containing material and a carbonaceous reducing agent onto the adhesion inhibitor, leveling the agglomerate fed onto the adhesion inhibitor, subsequently heating the agglomerate to reduce and melt the iron oxide contained in the agglomerate to produce a granular metallic iron, and discharging the produced granular metallic iron using a screw type discharger, wherein the adhesion inhibitor fed to the hearth is evenly leveled using a screw type adhesion inhibitor leveler so that the leveled adhesion inhibitor has a flatness of 40% or less of an average particle diameter of the agglomerate, and the agglomerate fed onto the adhesion inhibitor is evenly laid using a screw type agglomerate leveler so that the agglomerate forms a single layer.

3 Claims, 6 Drawing Sheets

(51) Int. Cl.

| | |
|---|---|
| ***B22F 9/30*** | (2006.01) |
| ***C21B 13/00*** | (2006.01) |
| ***C21B 13/02*** | (2006.01) |
| ***F27B 9/16*** | (2006.01) |
| ***F27B 9/38*** | (2006.01) |
| ***F27D 3/08*** | (2006.01) |
| *F27D 3/00* | (2006.01) |

(52) U.S. Cl.
CPC ..... *C21B 13/023* (2013.01); *C21B 13/105* (2013.01); *F27B 9/16* (2013.01); *F27B 9/38* (2013.01); *F27D 3/08* (2013.01); *F27D 2003/0004* (2013.01)

(56) References Cited

U.S. PATENT DOCUMENTS

| | | | | |
|---|---|---|---|---|
| 6,254,665 | B1 | 7/2001 | Matsushita et al. | |
| 6,648,942 | B2 * | 11/2003 | Hoffman et al. ..... | 75/484 |
| 2001/0025549 | A1 | 10/2001 | Tanigaki et al. | |

FOREIGN PATENT DOCUMENTS

| | | | |
|---|---|---|---|
| JP | 2001 288504 | | 10/2001 |
| JP | 2002-249813 | A | 9/2002 |

* cited by examiner (a)

(b)

METHOD FOR PRODUCING GRANULAR METALLIC IRON

TECHNICAL FIELD

The present invention relates to a method for producing a granular metallic iron, comprising leveling an adhesion inhibitor fed to the hearth of a moving-bed type hearth reducing melting furnace, subsequently feeding an agglomerate including an iron oxide-containing material and a carbonaceous reducing material onto the leveled adhesion inhibitor, leveling the agglomerate fed onto the adhesion inhibitor, and then reducing and melting the agglomerate to produce a granular metallic iron.

BACKGROUND ART

Known hitherto as moving-bed type hearth furnaces are a rotary-hearth furnace, which is equipped with an outer circumferential wall, an inner circumferential wall, and an annular rotary hearth disposed between these walls, and a linear-hearth furnace, which is equipped with two side walls and a linear hearth disposed between these walls.

In general, the rotary hearth comprises an annular furnace body frame, a hearth heat insulator disposed on the furnace body frame, and a refractory disposed on the hearth heat insulator.

The rotary-hearth furnace having such a structure has conventionally been used, for example, for the heat treatment of metals, e.g., steel billets, or the incineration treatment of combustible wastes. In recent years, however, a method for producing reduced iron from agglomerate including a carbonaceous reducing material and an iron oxide-containing material using the rotary-hearth furnace is coming to be put to practical use. Furthermore, a method for producing high-purity granular metallic iron by heating agglomerate including a carbonaceous reducing material and an iron oxide-containing material in a reducing melting furnace, e.g., a rotary-hearth furnace, to reduce the iron oxide contained in the feed material while keeping the iron oxide in a solid state, thereafter further heating the yielded metallic iron to melt them, and aggregating the iron while separating the iron from the slag components, has recently been developed.

In the method for producing reduced iron or producing granular metallic iron using a rotary-hearth furnace, it has been necessary that, for evenly heating the fed agglomerate, the agglomerate should be dispersed and leveled over the whole hearth without fail. There also has been a problem that the powder or the like generated from the agglomerate sinters on the hearth and adheres thereto, resulting in damage to the screw type discharger, etc.

Prior-art techniques for overcoming such problems are explained below by reference to FIG. 8. FIG. 8 is a view illustrating one example of methods for adding an adhesion inhibitor to agglomerate, according to Patent Literature 1.

First, Patent Literature 1 relates to a method for operating a rotary hearth type reducing furnace 21 in which agglomerate P including a powdery metal oxide and a powdery carbonaceous material is heated to reduce the metal oxide and thereby produce reduced iron. In this method, an adhesion inhibitor Q is added to the agglomerate P before the adhesion inhibitor Q is added into the furnace 21.

In Patent Literature 1, however, in the case where the adhesion inhibitor Q is not evenly laid when the adhesion inhibitor Q is added beforehand to the agglomerate P, the quantity of heat transferred to the agglomerate P from an upper part of the hearth 22 is uneven due to differences in surface level in the width direction and circumferential direction of the hearth 22. As a result, even and high-quality granular metallic iron is not obtained, resulting in a decrease in product yield. In the case where agglomerate P is laid on an adhesion inhibitor Q with the state that the adhesion inhibitor Q has differences in surface level in the circumferential direction and width direction of the hearth 22, this method has a problem that when the reduced iron obtained by reducing the agglomerate P is scraped out, the reduced iron gets under the adhesion inhibitor Q, resulting in a large amount of reduced iron remaining unscraped. In addition, the problem that molten iron accumulates to inhibit the production still remains unsolved.

Next, Patent Literature 2 relates to a method for leveling a feed material for granular reduced iron, in which a leveling member is lowered so as to reduce the gap between the hearth and the spiral blade of the leveling member in response to fluctuations in the amount of the feed material introduced. In this method, the leveling member is raised or lowered so that the rate at which the gap between the hearth and the spiral blade is increased or reduced in accordance with the rate at which the feed amount increases or decreases or with the rate at which the average particle diameter fluctuates is adjusted.

However, in Patent Literature 2, there is no description concerning influences of differences in the property of feed material on the rotation speed of the leveling member and on a relationship between the blade and the shaft. When the rotation speed of the leveler and the relationship between the blade and the shaft are not suited for the material to be leveled, this leads to a trouble that the feed material pass through or are scattered.

CITATION LIST

Patent Literature

Patent Literature 1: JP-A-2002-249813
Patent Literature 2: JP-A-2001-64710

SUMMARY OF INVENTION

Technical Problem

An object of the invention is to provide a method for producing a granular metallic iron, which comprises: leveling an adhesion inhibitor fed to the hearth of a moving-bed type hearth reducing melting furnace; feeding an agglomerate including an iron oxide-containing material and a carbonaceous reducing material onto the leveled adhesion inhibitor; leveling the agglomerate fed onto the adhesion inhibitor; subsequently heating the agglomerate to reduce and melt the iron oxide contained in the agglomerate to produce a granular metallic iron; and discharging the produced granular metallic iron using a screw type discharger, wherein the adhesion inhibitor leveler, the agglomerate leveler, the discharger, and the physical state of materials present on the hearth are optimized to thereby enable the agglomerate to be spread in a single layer and the agglomerate hence is evenly heat-treated to enable high-quality granular metallic iron to be produced in satisfactory yield.

Solution to Problem

The invention provides the following method for producing a granular metallic iron.

[1] A method for producing a granular metallic iron, which comprises:

leveling an adhesion inhibitor fed to a hearth of a moving-bed type hearth reducing melting furnace;

feeding an agglomerate including an iron oxide-containing material and a carbonaceous reducing material onto the leveled adhesion inhibitor;

leveling the agglomerate fed onto the adhesion inhibitor;

subsequently heating the agglomerate to reduce and melt the iron oxide contained in the agglomerate to produce a granular metallic iron; and discharging the produced granular metallic iron using a screw type discharger, wherein the adhesion inhibitor fed to the hearth is evenly leveled using a screw type adhesion inhibitor leveler so that the leveled adhesion inhibitor has a flatness of 40% or less of an average particle diameter of the agglomerate, and the agglomerate fed onto the adhesion inhibitor is evenly laid using a screw type agglomerate leveler so that the agglomerate forms a single layer.

[2] The method for producing a granular metallic iron according to [1], wherein after or at the same time as the granular metallic iron is discharged and before a fresh adhesion inhibitor is fed to the hearth, a surface layer of the used adhesion inhibitor remaining on the hearth is removed using the screw type discharger so that a residual used adhesion inhibitor remaining on the hearth has a flatness of 40% or less of the average particle diameter of the agglomerate.

[3] The method for producing a granular metallic iron according to [1] or [2], wherein screw shafts of at least one of the screw type adhesion inhibitor leveler, screw type agglomerate leveler and screw type discharger have a maximum amount of deflection during hot processing of 6 mm or less.

[4] The method for producing a granular metallic iron according to any one of [1] to [3], wherein the screw type adhesion inhibitor leveler has a first relative moving rate ratio defined by the following equation (1) and the screw type discharger has a second relative moving rate ratio defined by the following equation (2), at least one of the first relative moving rate ratio and second relative moving rate ratio being 10 to 30:

$$\text{First relative moving rate ratio}=(\text{outer diameter (mm) of screw of screw type adhesion inhibitor leveler})\times\tan(\text{lead angle (degrees)})\times(\text{number of threads})\times(\text{screw rotation speed (r/m)})\times\pi/60/(\text{moving rate at hearth center (mm/s)}) \quad (1),$$

$$\text{Second relative moving rate ratio}=(\text{outer diameter (mm) of screw of screw type discharger})\times\tan(\text{lead angle (degrees)})\times(\text{number of threads})\times(\text{screw rotation speed (r/m)})\times\pi/60/(\text{moving rate at hearth center (mm/s)}) \quad (2).$$

[5] The method for producing a granular metallic iron according to any one of [1] to [4], wherein the screw type agglomerate leveler has a third relative moving rate ratio defined by the following equation (3), the third relative moving rate ratio being 2 to 10:

$$\text{Third relative moving rate ratio}=(\text{outer diameter (mm) of screw of screw type agglomerate leveler})\times\tan(\text{lead angle (degrees)})\times(\text{number of threads})\times(\text{screw rotation speed (r/m)})\times\pi/60/(\text{moving rate at hearth center (mm/s)}) \quad (3).$$

[6] The method for producing a granular metallic iron according to any one of [1] to [5], wherein in the screw of at least one of the screw type adhesion inhibitor leveler, the screw type agglomerate leveler, and the screw type discharger, a plurality of divided blades are fixed to the outer periphery of a screw shaft with a bolt and nut or by welding to form a continuous screw blade, and a gap between the divided blades during hot processing is 3 mm or less.

[7] The method for producing a granular metallic iron according to any one of [1] to [6], wherein a screw shaft height of at least one of the levelers and discharger can be regulated from both sides of the hearth of the moving-bed type hearth reducing melting furnace in a width direction.

[8] The method for producing a granular metallic iron according to any one of [1] to [7], wherein the screw blade of at least one of the levelers and discharger has a lead angle in a range of 12 to 26 degrees.

Advantageous Effects of Invention

According to the method for producing a granular metallic iron as defined in the above [1], in the method for producing a granular metallic iron, which comprises leveling an adhesion inhibitor fed to the hearth of a moving-bed type hearth reducing melting furnace, feeding an agglomerate including an iron oxide-containing material and a carbonaceous reducing material onto the leveled adhesion inhibitor, leveling the agglomerate fed onto the adhesion inhibitor, subsequently heating the agglomerate to reduce and melt the iron oxide contained in the agglomerate to produce a granular metallic iron, and discharging the produced granular metallic iron using a screw type discharger, the adhesion inhibitor fed to the hearth is evenly leveled using a screw type adhesion inhibitor leveler so that the leveled adhesion inhibitor has a flatness of 40% or less of an average particle diameter of the agglomerate, and the agglomerate fed onto the adhesion inhibitor is evenly laid using a screw type agglomerate leveler so that the agglomerate forms a single layer.

As a result, the agglomerate fed onto the adhesion inhibitor in a downstream region of the moving-bed type hearth reducing melting furnace can be evenly laid so as to form a single layer without inhibition to the production of the granular metallic iron. Furthermore, when the granular metallic iron produced in the moving-bed type hearth reducing melting furnace is discharged, a reduction in the amount of granular metallic iron undischarged from the hearth is attained. As a result, accumulation of molten iron does not occur, and the production of the granular metallic iron is not inhibited.

According to the method for producing a granular metallic iron as defined in the above [2], in the method for producing a granular metallic iron according to [1], after or at the same time as the granular metallic iron is discharged and before a fresh adhesion inhibitor is fed to the hearth, a surface layer of the used adhesion inhibitor remaining on the hearth is removed using the screw type discharger so that a residual used adhesion inhibitor remaining on the hearth has a flatness of 40% or less of the average particle diameter of the agglomerate. Consequently, the newly added adhesion inhibitor is not inhibited from being evenly leveled. Furthermore, as in the method defined in the above [1], when the granular metallic iron produced in the moving-bed type hearth reducing melting furnace is discharged, a reduction in the amount of granular metallic iron undischarged from the hearth is attained. As a result, accumulation of molten iron does not occur, and the production of the granular metallic iron is not inhibited.

According to the method for producing a granular metallic iron as defined in the above [3], in the method for producing a granular metallic iron according to [1] or [2], the screw shafts of at least one of the screw type adhesion inhibitor leveler, screw type agglomerate leveler and screw type discharger have a maximum amount of deflection during hot processing of 6 mm or less. Consequently, the adhesion inhibitor and the agglomerate come to have a reduced difference in surface level between the center and end part in the width direction of the hearth. As a result, the granular metallic iron produced on the adhesion inhibitor is inhibited from getting into the adhesion inhibitor, and the amount of the granular metallic iron, which is produced on the hearth of the moving-bed type hearth reducing melting furnace and remains unscraped, is reduced.

According to the method for producing a granular metallic iron as defined in the above [4], in the method for producing a granular metallic iron according to any one of [1] to [3], the screw type adhesion inhibitor leveler has a first relative moving rate ratio defined by the equation (1) given above and the screw type discharger has a second relative moving rate ratio defined by the equation (2) given above, at least one of the first relative moving rate ratio and second relative moving rate ratio being 10 to 30. Consequently, the effect described below is attained.

According to this method for producing a granular metallic iron, the adhesion inhibitor neither is scattered by the screw blade of the screw type adhesion inhibitor leveler and/or the screw blade of the screw type discharger nor passes under the screw blades, and a smooth surface of the adhesion inhibitor can be formed on the hearth. In the case where the first relative moving rate ratio and/or second relative moving rate ratio is 30 or less, the occurrence of scattering the adhesion inhibitor is inhibited and the adhesion inhibitor can be leveled to a flatness which satisfies the flatness defined in the above [1]. On the other hand, in the case where the first relative moving rate ratio and/or second relative moving rate ratio is 10 or more, the occurrence of the adhesion inhibitor being passing under the screw blade of the screw type adhesion inhibitor leveler and/or screw blade of the screw type discharger is inhibited and, hence, the adhesion inhibitor can be leveled to a flatness which satisfies the flatness defined in the above [1].

According to the method for producing a granular metallic iron as defined in the above [5], in the method for producing a granular metallic iron according to any one of [1] to [4], the screw type agglomerate leveler has a third relative moving rate ratio defined by the equation (3) given above, the third relative moving rate ratio being 2 to 10. Consequently, the agglomerate neither is scattered by the screw blade of the screw type agglomerate leveler nor passes under the screw blade. Namely, in the case where the third relative moving rate ratio is 10 or less, the occurrence of scattering the agglomerate is inhibited, and then, a decrease in the spread density of the agglomerate or occurrence of stacking of the agglomerate is inhibited. On the other hand, in the case where the third relative moving rate ratio is 2 or more, the occurrence of the agglomerate being passing under the screw blade of the screw type agglomerate leveler is inhibited and, hence, the occurrence of stacking of the agglomerate is inhibited, making it easy to lay the agglomerate so as to form a single layer.

Meanwhile, according to the method for producing a granular metallic iron as defined in the above [6], in the method for producing a granular metallic iron according to any one of [1] to [5], in the screw of at least one of the screw type adhesion inhibitor leveler, the screw type agglomerate leveler, and the screw type discharger, a plurality of divided blades are fixed to the outer periphery of a screw shaft with a bolt and a nut or by welding to form a continuous screw blade, and a gap between the divided blades during hot processing is 3 mm or less. Consequently, the agglomerate is inhibited from getting in between the divided blades. As a result, a flatness is retained in the tips of screw blade and, hence, the flatness of the hearth also is ensured.

According to the method for producing a granular metallic iron as defined in the above [7], in the method for producing a granular metallic iron according to any one of [1] to [6], a screw shaft height of at least one of the levelers and discharger can be regulated from both sides of the hearth of the moving-bed type hearth reducing melting furnace in a width direction. Since each of the screw wear rates of the screw type agglomerate leveler, screw type discharger, and screw type adhesion inhibitor leveler is not constant, the relative positions of the respective levelers and discharger should be regulated at regular or irregular intervals. By configuring the levelers and the discharger so that the screw heights thereof can be regulated from both sides of the hearth in a width direction, an operation level suitable for the state of wear can be easily set.

Furthermore, according to the method for producing a granular metallic iron as defined in the above [8], in the method for producing a granular metallic iron according to any one of [1] to [7], the screw blade of at least one of the levelers and discharger has a lead angle in a range of 12 to 26 degrees. Consequently, leveling of the agglomerate with the leveler and scraping of the granular metallic iron with the discharger are not difficult. In the case where the lead angle of the screw blade is 12 degrees or more, the occurrence of the agglomerate or granular metallic iron being getting into the adhesion inhibitor is inhibited when the agglomerate is leveled or the granular metallic iron is discharged. In this case, an amount of the granular metallic iron unscraped is decreased. On the other hand, in the case where the lead angle of the screw blade is 26 degrees or less, it is easy to evenly level the agglomerate and it is easy to scrape out the granular metallic iron when the granular metallic iron is scrapped.

BRIEF DESCRIPTION OF DRAWINGS

FIG. 3(*a*) illustrates the case where the screw shaft is deflected, and FIG. 3(*b*) illustrates the case where the screw shaft is not deflected, the agglomerate being omitted in FIGS. 3(*a*) to (*b*).

DESCRIPTION OF EMBODIMENTS

First, an embodiment of the method for producing granular metallic iron of the invention is explained, in which a rotary-hearth furnace is used as the moving-bed type hearth reducing melting furnace, by reference to FIGS. 1 to 4.

Figure 1:
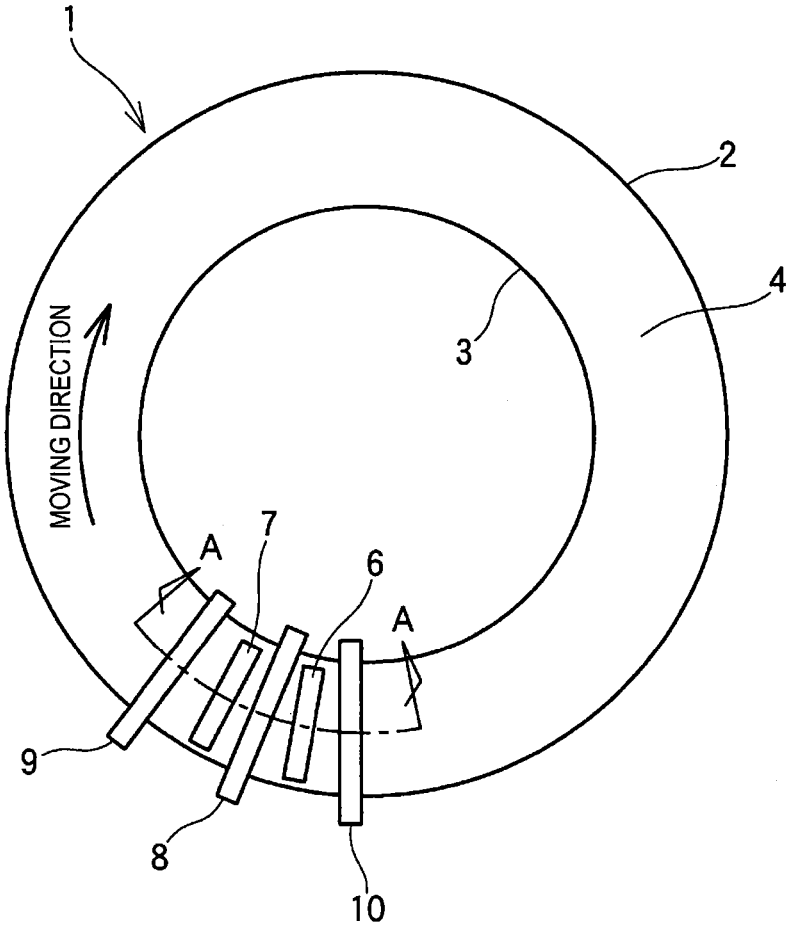
FIG. 1 is a diagrammatic plan view of the main body of a rotary-hearth furnace for illustrating an embodiment of the method for producing granular metallic iron of the invention.
Figure 2:
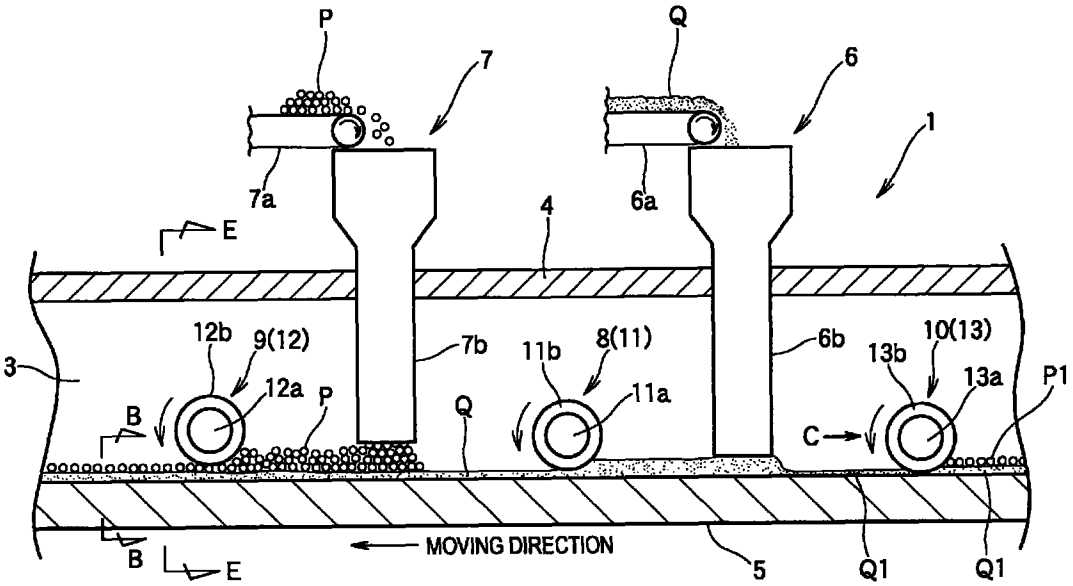
FIG. 2 is a diagrammatic sectional elevational view taken in the direction of the arrows along the arcuate line A-A of FIG. 1.
Figure 3:
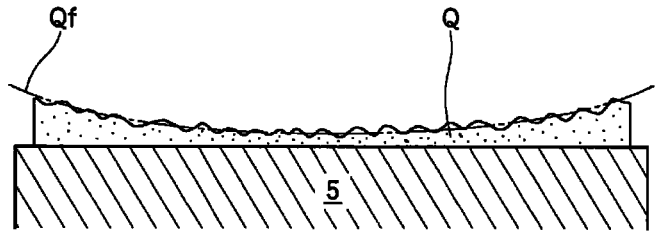
FIGS. 3(*a*) to (*b*) are diagrammatic sectional elevational views taken in the direction of the arrows along the line B-B of FIG. 2.
Figure 3:
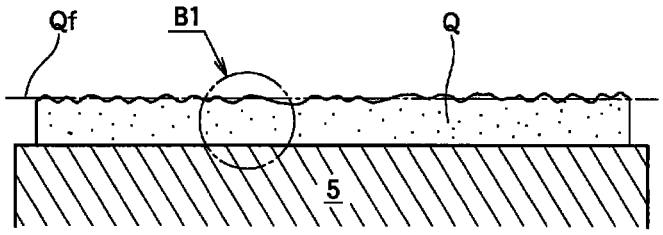
Figure 4:
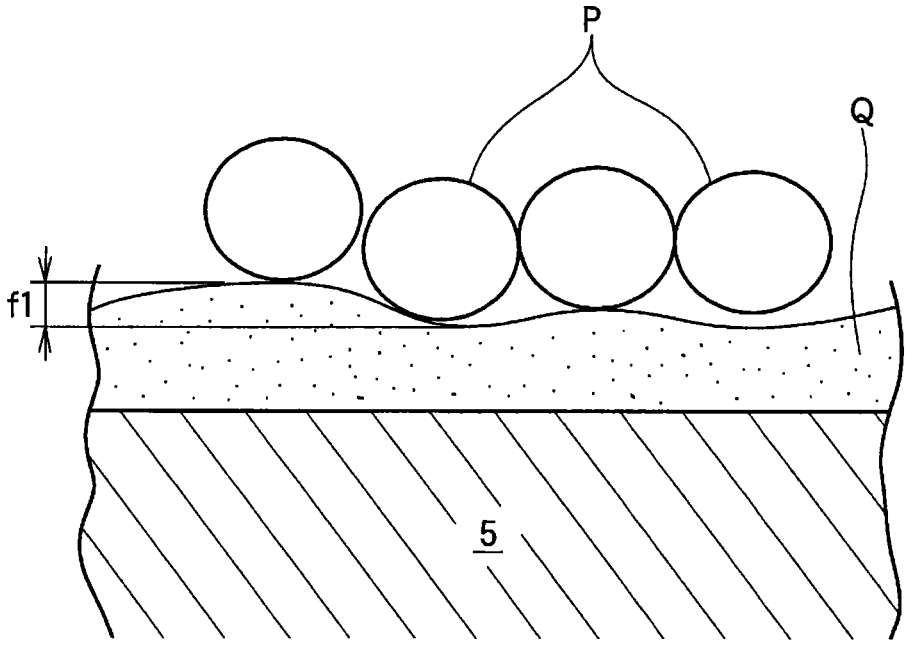
FIG. 4 is an enlarged detail view of the area B1 of FIG. 3(*b*).

FIG. 1 is a diagrammatic plan view of the main body of a rotary-hearth furnace for illustrating the embodiment of the method for producing granular metallic iron of the invention. FIG. 2 is a diagrammatic sectional elevational view taken in the direction of the arrows along the arcuate line A-A of FIG. 1. FIGS. 3(*a*) to (*b*) are diagrammatic sectional elevational views taken in the direction of the arrows along the line B-B of FIG. 2; FIG. 3(*a*) illustrates the case where the screw shaft is deflected, and FIG. 3(*b*) illustrates the case where the screw shaft is not deflected, the agglomerate being omitted in FIGS. 3(*a*) to (*b*). FIG. 4 is an enlarged detail view of the area B1 of FIG. 3(*b*).

This rotary-hearth furnace 1 is equipped with an outer circumferential wall 2, an inner circumferential wall 3 disposed on the inner side of the outer circumferential wall 2, a ceiling part 4 which covers the space between the outer circumferential wall 2 and the inner circumferential wall 3 from above, and an annular rotary hearth (hereinafter also referred to simply as "hearth") 5 disposed between the outer circumferential wall 2 and the inner circumferential wall 3. The outer circumferential wall 2, inner circumferential wall 3, and ceiling part 4 are constituted mainly of a heat insulator.

The rotary hearth 5 is operated by a driving device, which is not shown, so that the rotary hearth 5 rotates in the direction of the arrow along the circumference between the outer circumferential wall 2 and the inner circumferential wall 3. An adhesion inhibitor Q comprising a powdery material including a carbonaceous material, e.g., coal, is conveyed with the belt conveyor 6*a* of an adhesion inhibitor feeder 6 and added first onto the rotary hearth 5 through a receiving hopper 6*b*.

The term "adhesion inhibitor" Q herein means a substance that is scatteringly present around agglomerate P, which will be described later, in the state that the agglomerate P is placed over the rotary hearth 5, and that serves to prevent the formation of adherent matter in the form of, for example, a plate. Namely, even when a powder generated from the agglomerate P during reducing or a powder generated during discharge of granular metallic iron remains on the hearth 5 and remains in the furnace over a long period, the particles of the carbonaceous material added as an adhesion inhibitor Q are present in the interstices between the reduced metal and slag component to prevent the metal and the slag from bonding together. Consequently, the reduced metal and the slag do not grow into platy adherent matter extending over a large area.

Even when an adherent matter is formed, it can be easily cracked from particles of the carbonaceous material which is used as an adhesive inhibitor Q because the particles of the carbonaceous material act as an origin by relatively small force. Thus, the adherent matter is reduced into small pieces and can be easily separated from the hearth 5. In place of the adhesion inhibitor Q comprising a powdery carbonaceous material, use may be made of either an adhesion inhibitor Q comprising a powdery material including one or more of CaO, MgO, and $Al_2O_3$ as the main component or an adhesion inhibitor Q comprising a mixture of the powdery carbonaceous material and a powdery material including one or more of CaO, MgO, and $Al_2O_3$.

The adhesion inhibitor Q added onto the rotary hearth 5 is subsequently leveled evenly with a screw type adhesion inhibitor leveler 8. Furthermore, agglomerate (feed material for granular metallic iron) P, which includes an iron oxide-containing material and a carbonaceous reducing material and has a particle diameter of 16 to 22 mm, is conveyed with the belt conveyor 7*a* of an agglomerate feeder 7, and added, through a receiving hopper 7*b*, onto the adhesion inhibitor Q which has been evenly leveled on the rotary hearth 5.

The agglomerate P added onto the adhesion inhibitor Q is then evenly leveled with a screw type agglomerate leveler 9 as will be described later. The agglomerate P is heated in the furnace while rotating the rotary hearth 5, and the iron oxide contained in the agglomerate P is thereby reduced and melted. The resultant granular metallic iron P1 is discharged with a screw type discharger 10. Thus, granular metallic iron P1 is produced.

In this embodiment of the method for producing granular metallic iron of the invention, the adhesion inhibitor Q fed to the hearth 5 is leveled using the screw type adhesion inhibitor leveler 8 so that the leveled adhesion inhibitor Q has a flatness of 40% or less, preferably 20% or less, of the average particle diameter of the agglomerate P. In addition, the agglomerate P fed onto the adhesion inhibitor Q is evenly leveled using the screw type agglomerate leveler 9.

As a result, the agglomerate P fed onto the adhesion inhibitor Q in a downstream region of the rotary-hearth furnace 1 can be evenly laid so as to form a single layer, as will be described later, without inhibition to the production of the granular metallic iron.

Furthermore, when the granular metallic iron P1 produced in the rotary-hearth furnace 1 is discharged, a reduction in the amount of granular metallic iron P1 undischarged from the hearth 5 is attained. As a result, accumulation of molten iron does not occur, and the factor which inhibits production is eliminated.

An explanation is given here on the "flatness" of the leveled adhesion inhibitor Q and on the "average particle diameter" of the agglomerate P, while referring to FIGS. 3 (*a*) to (*b*) and 4. First, the "flatness" f1 of the leveled adhesion inhibitor Q has the following meaning. With respect to an arbitrary selected part of the rotary hearth 5 on which the adhesion inhibitor Q that has been leveled is present, a section of the overall width of the hearth 5 which is perpendicular to the rotation direction and a section of the overall circumference of the hearth 5 which is along the rotation direction are examined, while excluding any influence of the deflection of the screw shaft 11*a* of the screw type adhesion inhibitor leveler 8 as shown in FIG. 3(*b*). The term "flatness" means the vertical distance between the highest crest and the lowest trough within each section showing the surface irregularities of the dispersed adhesion inhibitor Q.

Reference sign Qf in FIGS. 3(*a*) to (*b*) indicates the average surface of the adhesion inhibitor Q which has been leveled. Meanwhile, FIG. 3(*b*) is a view for illustrating the "flatness" of the overall width of the hearth 5 which is perpendicular to the rotation direction. The "flatness" of the overall circumference of the hearth 5 which is along the rotation direction also has the same meaning, except that the direction differs from the direction used for the "flatness" of the overall width of the hearth 5, although omitted in the figure.

The "flatness" of the hearth 5 in the width direction perpendicular to the rotation direction is determined by setting and stretching a piano wire over the hearth 5 throughout the overall width thereof in the width direction in approximately parallel with the surface of the hearth 5, actually measuring the vertical distance from the piano wire to the surface of the adhesion inhibitor Q with a ruler or the like at each of a plurality of sites, and excluding any influence of the deflection of the screw shaft 11*a* which is determined through calculation. The expression "approximately parallel" means such a degree of flatness that the piano wire and the surface of the hearth 5 are visually regarded as substantially parallel, because the surface of the hearth 5 has irregularities. On the other hand, the "flatness" of the overall circumference of the hearth 5 which is along the rotation direction can be determined by marking a plurality of sites on the piano wire set and stretched over the hearth 5 throughout the overall width thereof, actually measuring the vertical distance from each marked site of the piano wire to each surface of the adhesion inhibitor Q with a ruler or the like while rotating the hearth 5 little by little until the hearth 5 makes one revolution, and comparing the measured data in the same measuring point.

Furthermore, the term "average particle diameter" in the invention means a mass-average particle diameter determined by classifying the particles by screening and then calculating the average particle diameter from the representative particle diameter of each fraction which has particle sizes between the opening size of one screen and the opening size of the next screen and from the mass of the fraction. For example, when the particles are classified with screens having opening sizes of $D_1$, $D_2$, $D_n$, $D_{n+1}$ ($D_1<D_2<\ldots<D_n<D_{n+1}$) and the mass of the fraction having particle sizes between the opening sizes of $D_k$ and $D_{k+1}$ is expressed by $W_k$, then the mass-average particle diameter $d_m$ is defined by $d_m=\Sigma_{k=1,n}(W_k\times d_k)/\Sigma_{k=1,n}(W_k)$. Reference sign $d_k$ is a representative diameter of the fraction having particle sizes between the opening sizes of $D_k$ and $D_{k+1}$, and $d_k=(D_k+D_{k+1})/2$.

When the average particle diameter of the agglomerate P is expressed by $d_m$, then the flatness f1 of the adhesion inhibitor Q satisfies $f1\leq 0.4\times d_m$, preferably $f1\leq 0.2\times d_m$. In addition, the agglomerate P fed onto the adhesion inhibitor Q is evenly leveled using the screw type agglomerate leveler 9. By leveling the adhesion inhibitor Q so that the flatness f1 thereof satisfies $f1\leq 0.4\times d_m$, the agglomerate P fed onto the adhesion inhibitor Q in a downstream region of the rotary-hearth furnace 1 can be laid so as to form a substantially single layer including no agglomerate stacked in a vertical direction, as shown in FIG. 4. Furthermore, by regulating the flatness f1 so as to satisfy $f1\leq 0.2\times d_m$, the agglomerate P fed onto the adhesion inhibitor Q in a downstream region of the rotary-hearth furnace 1 can be laid so as to form a single layer including no agglomerate stacked in a vertical direction.

Meanwhile, in the case where the flatness f1 of the adhesion inhibitor Q is $f1>0.4\times d_m$, due to the large difference in surface level of the top surface of the adhesion inhibitor Q, the agglomerate P fed onto the adhesion inhibitor Q is stacked in a vertical direction. As a result, the agglomerate P cannot be laid so as to form a single layer, in the downstream region of the rotary-hearth furnace 1.

After or at the same time as the granular metallic iron P1 is discharged and before a fresh adhesion inhibitor Q is fed to the hearth 5, a surface of the used adhesion inhibitor Q1 adherent to the hearth 5 is removed using a screw type discharger 10 so that the residual used adhesion inhibitor Q1 remaining on the hearth 5 has a flatness f2 of 40% or less of the average particle diameter $d_m$ of the agglomerate P. This flatness f2 differs from the flatness f1 in that f1 is the flatness of the leveled adhesion inhibitor Q, while f2 is the flatness of the used adhesion inhibitor Q1 remaining on the rotary hearth 5.

By regulating the flatness f2 of the adhesion inhibitor Q1 remaining on the rotary hearth 5 so as to satisfy $f2\leq 0.4\times d_m$, the adhesion inhibitor Q newly fed can be evenly leveled without being inhibited. In addition, when the granular metallic iron P1 produced in the rotary-hearth furnace 1 is discharged, a reduction in the amount of granular metallic iron P1 undischarged from the rotary hearth 5 is attained. As a result, substantially no accumulation of molten iron occurs, and the production of the granular metallic iron is not substantially inhibited. Furthermore, by regulating the flatness f2 so as to satisfy $f2\leq 0.2\times d_m$, the adhesion inhibitor Q newly fed can be evenly leveled without causing a problem. Moreover, when the granular metallic iron P1 produced in the rotary-hearth furnace 1 is discharged, a reduction in the amount of granular metallic iron P1 undischarged from the rotary hearth 5 is attained. As a result, no accumulation of molten iron occurs, and the production is not inhibited.

In the case where the residual adhesion inhibitor Q1 has a flatness f2 of $f2>0.4\times d_m$, it is impossible to evenly level the adhesion inhibitor Q newly fed. Because of this, when the granular metallic iron P1 produced in the rotary-hearth furnace 1 is discharged, an amount of granular metallic iron P1 undischarged from the rotary hearth 5 is increased, resulting in accumulation of molten iron and inhibition of the production of the granular metallic iron.

Figure 5:
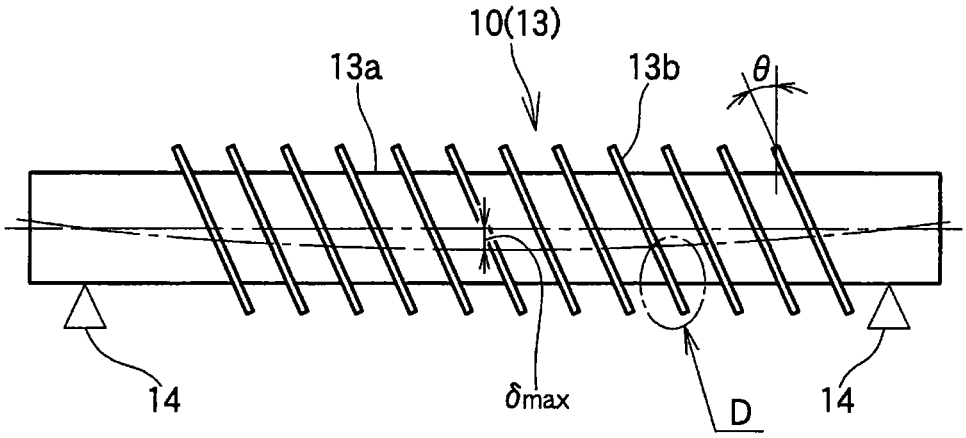
FIG. 5 is a diagrammatic view of the screw of the screw type discharger of FIG. 2, taken from the direction of the arrow C.

Next, with respect to the deflection of each of the screw shafts 11*a* and 13*a* of the screw type adhesion inhibitor leveler 8, screw type agglomerate leveler 9 and screw type discharger 10 according to an embodiment of the invention, the screw 13 of the screw type discharger 10 is explained first as an example by reference to FIGS. 2 and 5. FIG. 5 is a diagrammatic view of the screw of the screw type discharger of FIG. 2, taken from the direction of the arrow C. The screw 13 of the screw type discharger 10 is equipped with a screw shaft 13*a*, which is supported at both ends by bearings 14 and 14, and a screw blade 13*b*.

The screw shaft 13*a* of the screw type discharger 10 having such a configuration has a maximum amount of deflection δmax of 6 mm or less, preferably 3 mm or less. Consequently, the granular metallic iron P1 and adhesion inhibitor Q, which remain on the hearth 5 after discharge, have a reduced difference in surface level between the center and end part which are located along the width direction of the hearth 5. The amount of the granular metallic iron P1, which is produced on the hearth 5 of the rotary-hearth furnace 1 and remains unscraped, is hence reduced.

Likewise, the screw shaft 11*a* of the screw type adhesion inhibitor leveler 8 has a maximum amount of deflection δmax of 6 mm or less, preferably 3 mm or less. Consequently, the adhesion inhibitor Q has a reduced difference in surface level between the center and end part which are located along the width direction of the hearth 5. The granular metallic iron P1 produced on the adhesion inhibitor Q is hence inhibited from getting into the adhesion inhibitor Q. Furthermore, the screw shaft 12*a* of screw type agglomerate leveler 9 has a maximum amount of deflection δmax of 6 mm or less, preferably 3 mm or less. Consequently, agglomerate P does not pass under the screw blade 12*b* and occurring of stacking of the agglomerate P is inhibited. The maximum amount of deflection of the screw shaft 11*a* or 13*a* during hot processing is determined through calculation on the basis of a simple-supported beam model.

Furthermore, the screw type adhesion inhibitor leveler 8 has a first relative moving rate ratio defined by the following equation (1) and the screw type discharger 10 has a second relative moving rate ratio defined by the following equation (2), at least one of the first relative moving rate and second relative moving rate ratio being 10 to 30.

First relative moving rate ratio=(outer diameter (mm) of screw of screw type adhesion inhibitor leveler)×tan(lead angle (degrees))×(number of threads)×(screw rotation speed (r/m))×π/60/(moving rate at hearth center (mm/s)) (1)

Second relative moving rate ratio=(outer diameter (mm) of screw of screw type discharger)×tan(lead angle (degrees))×(number of threads)×(screw rotation speed (r/m))×π/60/(moving rate at hearth center (mm/s)) (2)

According to this method for producing granular metallic iron, the adhesion inhibitor Q neither is scattered by the screw blade 11*b* of the screw type adhesion inhibitor leveler 8 and/or screw blade 13*b* of the screw type discharger 10 nor passes under the screw blades 11*b* and 13*b*, and a smooth surface of the adhesion inhibitor Q can be formed on the hearth. In the case where the first relative moving rate ratio and/or second relative moving rate ratio is 30 or less, the occurrence of scattering the adhesion inhibitor Q is inhibited and the adhesion inhibitor Q can be leveled to a flatness f1 which satisfies the flatness defined in the above [1]. On the other hand, in the case where the first relative moving rate ratio and/or second relative moving rate ratio is 10 or more, the occurrence of the adhesion inhibitor Q being passing under the screw blade 11*b* of the screw type adhesion inhibitor leveler 8 and/or screw blade 13*b* of the screw type discharger 10 are inhibited and, hence, the adhesion inhibitor Q can be leveled to a flatness f1 which satisfies the flatness defined in the above [1].

Moreover, the screw type agglomerate leveler 9 has a third relative moving rate ratio defined by the following equation (3), the third relative moving rate ratio being 2 to 10.

$$\text{Third relative moving rate ratio}=(\text{outer diameter (mm) of screw of screw type agglomerate leveler})\times\tan(\text{lead angle (degrees)})\times(\text{number of threads})\times(\text{screw rotation speed (r/m)})\times\pi/60/(\text{moving rate at hearth center (mm/s)}) \quad (3)$$

The "lead angle" in the equations (1) to (3) given above means a lead angle of each screw blade. In the case of the screw type discharger 10, the lead angle is expressed by reference sign θ in FIG. 5. The term "number of threads" means the number of threads of the screw blade, and the term "moving rate at hearth center" means the moving rate at the center of the hearth 5 in a width direction.

According to this method for producing granular metallic iron, the agglomerate P neither is scattered by the screw blade 12*b* of the screw type agglomerate leveler 9 nor passes under the screw blade 12*b*. Namely, in the case where the third relative moving rate ratio is 10 or less, the occurrence of scattering the agglomerate P is inhibited, and a decrease in the spread density of the agglomerate P or occurrence of stacking of the agglomerate P is inhibited. On the other hand, in the case where the third relative moving rate ratio is 2 or more, the occurrence of the agglomerate P being passing under the screw blade 12*b* of the screw type agglomerate leveler 9 is inhibited and, hence, the occurrence of stacking of agglomerate P is inhibited, making it easy to lay the agglomerate so as to form a single layer.

Figure 6:
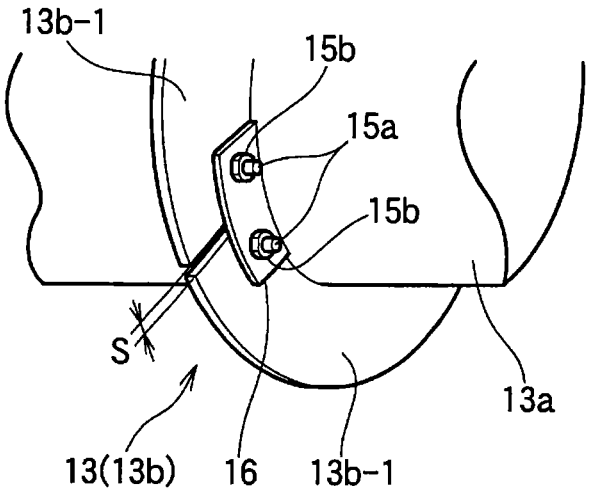
FIG. 6 is a diagrammatic perspective view of the part D of FIG. 5, taken from the right side.

Next, with respect to each of the screws 11, 12, and 13 of the screw type adhesion inhibitor leveler 8, screw type agglomerate leveler 9, and screw type discharger 10 according to an embodiment of the invention, the screw 13 of the screw type discharger 10 is explained first as an example by reference to FIGS. 2 and 6. FIG. 6 is a diagrammatic perspective view of the part D of FIG. 5, taken from the right side.

The screw 13 of the screw type discharger 10 is configured by fixing a plurality of divided blades 13*b*-1 to the outer periphery of a screw shaft 13*a* by means of a bolt 15*a* and a nut 15*b* through a lug 16 to form a continuous screw blade 13*b*. In the case where the screw blade 13*b* is thus configured of divided blades, a gap S for absorbing thermal expansion is required between the divided blades 13*b*-1 and 13*b*-1. However, the gap S between the divided blades 13*b*-1 and 13*b*-1 during hot processing is 3 mm or less. Consequently, granular metallic iron P1 is inhibited from getting in between the divided blades 13*b*-1 and 13*b*-1. As a result, a flatness is retained in the tips of the screw blade 13*b* and, hence, the flatness of the hearth 5 also can be ensured.

Likewise, with respect to each of the screws 11 and 12 of the screw type adhesion inhibitor leveler 8 and screw type agglomerate leveler 9, they are configured by fixing a plurality of divided blades to the outer periphery of a screw shaft 11*a* or 12*a* by means of a bolt and a nut through a lug to form a continuous screw blade 11*b* or 12*b*.

In addition, the gap S between the divided blades during hot processing is 3 mm or less. Consequently, agglomerate P is inhibited from getting in between the divided blades. As a result, a flatness is retained in the tips of the screw blade 11*b* or 12*b* and, hence, the flatness of the agglomerate P over the hearth 5 can also be ensured. The fixing of divided blades to the outer periphery of a screw shaft may be conducted by welding.

Figure 7:
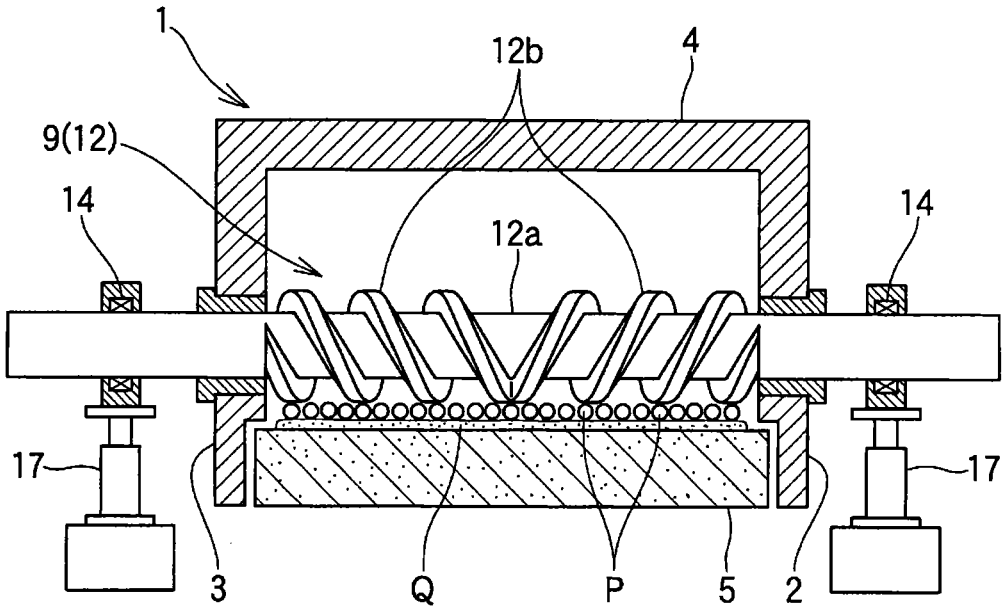
FIG. 7 is a diagrammatic sectional elevational view taken in the direction of the arrows along the line E-E of FIG. 2.
Figure 8:
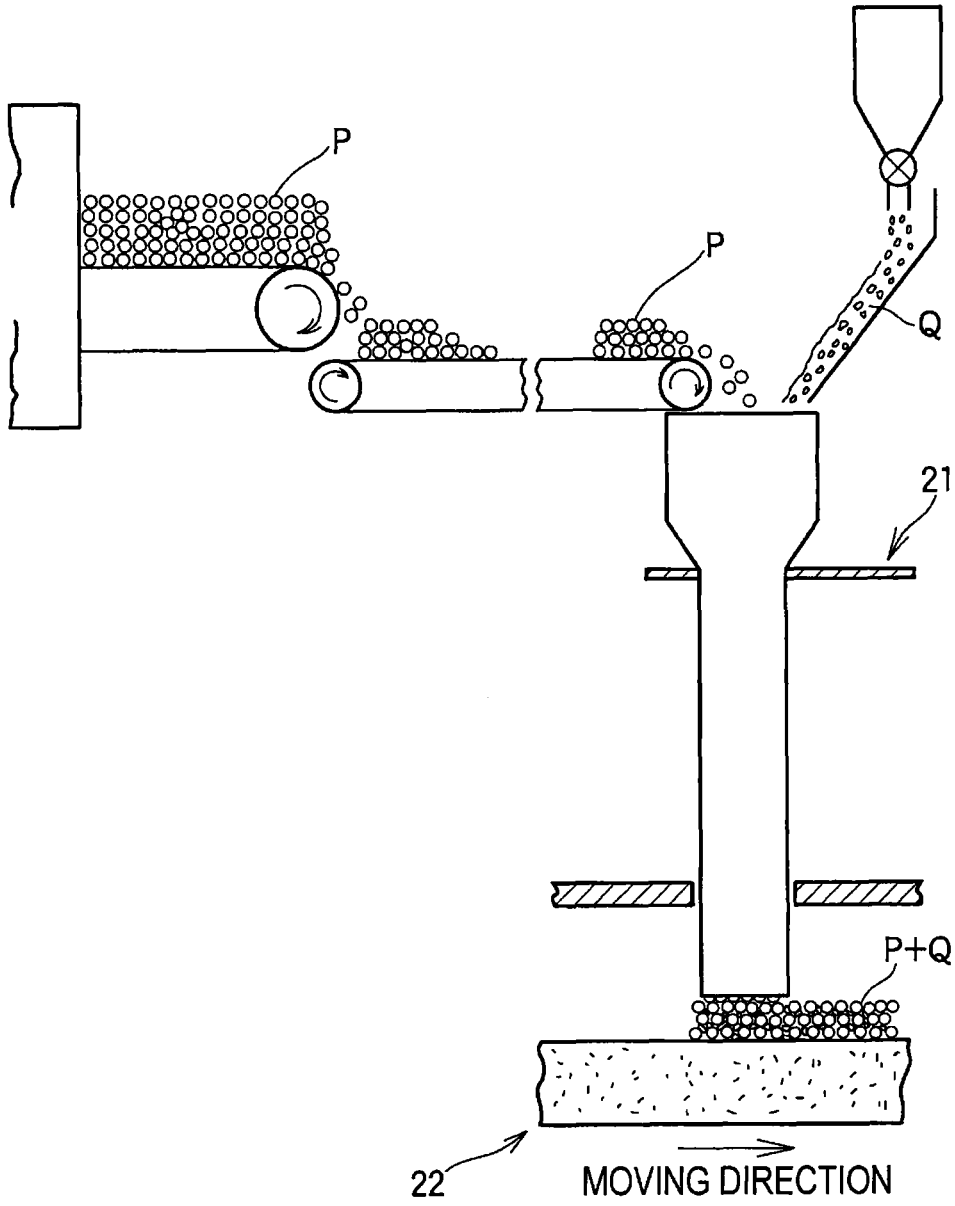
FIG. 8 is a view illustrating an example of methods for adding an adhesion inhibitor to agglomerate, the example being in accordance with Patent Literature 1.

Next, with respect to each of the screw shafts 11*a*, 12*a*, and 13*a* of the screw type adhesion inhibitor leveler 8, screw type agglomerate leveler 9, and screw type discharger 10 according to an embodiment of the invention, the screw shaft 12*a* of the screw type agglomerate leveler 9 is explained first as an example by reference to FIG. 7.

FIG. 7 is a diagrammatic sectional elevational view taken in the direction of the arrows along the line E-E of FIG. 2.

This screw type agglomerate leveler 9 is configured so that the height of the screw shaft 12*a* can be regulated by means of electric cylinders 17 for shaft raising/lowering which are disposed on both outer sides of the outer circumferential wall 2 and inner circumferential wall 3 along the width direction of the hearth 5. Since the wear rate of the screw 12 (specifically, the screw blade 12*b*) of the screw type agglomerate leveler 9 is not constant, the relative position of this leveler 9 should be regulated at regular or irregular intervals. However, by configuring the leveler 9 so that the height of the screw shaft 12*a* of the leveler 9 can be regulated from both the inner and outer peripheral sides of the hearth 5, an operation level suitable for the state of wear can be easily set. Incidentally, in the screw 12 of the screw type agglomerate leveler 9 shown in FIG. 7, the direction of the helical thread in the screw blade 12*b* is inverted at the lengthwise-direction center. However, the screw blade 12*b* may have either of the two helical-thread directions without inversion.

Likewise, since the wear rates of each of the screws 11 and 13 (specifically, the screw blades 11*b* and 13*b*) of the screw type adhesion inhibitor leveler 8 and screw type discharger 10 are not constant, it is necessary to regulate the relative positions of the respective leveler 8 and discharger 10. However, by configuring the leveler 8 and the discharger 10 so that each of the heights of the screw shafts 11*a* and 13*a* thereof can be regulated from both outer sides of the hearth 5 in the width direction, an operation level suitable for the state of wear can be easily set.

It is preferred that each of the screw blades 11*b*, 12*b*, and 13*b* of the screw type adhesion inhibitor leveler 8, screw type agglomerate leveler 9, and screw type discharger 10 should have a lead angle in the range of 12 to 26 degrees.

In the case where the lead angle θ of the screw blade 13*b* is 12 degrees or more, the following advantages are attained. When agglomerate P is leveled with the screw type agglomerate leveler 9, the occurrence of the agglomerate P being getting into the adhesion inhibitor Q is inhibited. When granular metallic iron P1 is discharged with the screw type discharger 10, the occurrence of the granular metallic iron P1 being getting into the adhesion inhibitor Q is inhibited, resulting in a decreased amount of granular metallic iron remaining unscraped. On the other hand, in the case where the lead angle θ of the screw blade 11*b* or 12*b* is 26 degrees or less, it is easy to evenly level the agglomerate P with the screw type agglomerate leveler 9 and it is easy to scrape out the granular metallic iron P1 with the screw type discharger 10.

As described above, according to the method for producing granular metallic iron of the invention, the adhesion inhibitor fed to the hearth is evenly leveled using a screw type adhesion inhibitor leveler so that the leveled adhesion inhibitor has a flatness of 40% or less of the average particle diameter of the agglomerate, and the agglomerate fed onto the adhesion inhibitor is evenly laid using a screw type agglomerate leveler so that the agglomerate forms a single layer. Consequently, the agglomerate fed onto the adhesion inhibitor in a downstream region of the moving-bed type hearth reducing melting furnace can be evenly laid so as to form a single layer without being inhibited. Furthermore, when the granular metallic iron produced in the moving-bed type hearth reducing melting furnace is discharged, a reduction in the amount of granular metallic iron undischarged from the hearth is attained. As a result, accumulation of molten iron does not occur, and the production of the granular metallic iron is not inhibited.

EXAMPLES

Examples in which the rotary-hearth furnace explained as in the above embodiments was used as the moving-bed type hearth reducing melting furnace according to the invention are explained below by reference to FIGS. 1 to 6. In the Examples, use was made of an adhesion inhibitor Q having particle diameters of 3 mm or less and agglomerate P having particle diameters of 16 to 22 mm and an average particle diameter $d_m$ of 18 mm.

Example 1

Examples 1-1 to 1-2 and Comparative Example 1-1

First, an adhesion inhibitor Q fed to the rotary hearth 5 with the adhesion inhibitor feeder 6 was evenly leveled using the screw type adhesion inhibitor leveler 8 so that the leveled adhesion inhibitor Q had various values of flatness f1. With respect to each of the ratios of the resultant values of flatness f1 to the average particle diameter $d_m$ of agglomerate ($f1/d_m$), agglomerate P was fed onto the leveled adhesion inhibitor Q and leveled using the screw type agglomerate leveler 9. The results thereof are summarized in Table 1 under Example 1 (Examples 1-1 to 1-2 and Comparative Example 1-1).

The results show the following. In Comparative Example 1-1, in which the ratio of the flatness f1 to the average particle diameter $d_m$ of agglomerate ($f1/d_m$) was in the range of 45 to 63%, there were a large number of areas where the agglomerate P was stacked in a vertical direction. In contrast, in Example 1-2, in which the ratio ($f1/d_m$) was in the range of 27 to 38%, the agglomerate P was able to be laid so as to form a substantially single layer. In Example 1-1, in which the ratio ($f1/d_m$) was in the range of 14 to 19%, the agglomerate P was able to be laid so as to form an even single layer. When the ratio ($f1/d_m$) is less than 14%, this means that the value of flatness f1 of the adhesion inhibitor Q is smaller. It is therefore apparent, without requiring an actual examination, that the agglomerate P can be laid so as to form a more even single layer.

Namely, since the ratio ($f1/d_m$) is regulated so as to be 40% or less, preferably 20% or less, and the agglomerate P fed onto the adhesion inhibitor Q is evenly leveled using the screw type agglomerate leveler 9, the agglomerate P fed onto the adhesion inhibitor Q in a downstream region of the hearth 5 can be laid so as to form a single layer without being inhibited.

Example 2

Examples 2-1 to 2-4 and Comparative Examples 2-1 to 2-2

Next, granular metallic iron P1 was produced by using some different values of the outer diameters and lead angles θ of the screw blades 11*b* and 13*b* of the screw type adhesion inhibitor leveler 8 and screw type discharger 10, using different moving rates at the center of the hearth 5, and changing the first and second relative moving rate ratios of the leveler 8 and discharger 10, which are defined respectively by the equations (1) and (2) given above. The results thereof are summarized in Table 2 under Example 2 (Examples 2-1 to 2-4 and Comparative Examples 2-1 to 2-2). In this Example 2 (Examples 2-1 to 2-4 and Comparative Examples 2-1 to 2-2), each of the screw shafts 11*a* and 13*a* of the screw type adhesion inhibitor leveler 8 and screw type discharger 10 during the hot processing had a maximum amount of deflection δmax of 3 mm.

The results show the following. In Comparative Example 2-1, in which the first or second relative moving rate ratio was 5, the adhesion inhibitor Q passed through the gap between the screw blade 11*b* of the screw type adhesion inhibitor leveler 8 and the hearth 5, and the agglomerate P leveled thereon formed local protrusions. In Comparative Example 2-2, in which the first or second relative moving rate ratio was 38, the adhesion inhibitor Q was scattered by the screw blade 11*b*, and in the agglomerate P leveled thereon, local stacking occurred and areas where the particles were thinly laid occurred. In contrast, in each of Examples 2-1 to 2-4, in which the first or second relative moving rate ratios were in the range of 11 to 27, the agglomerate P was able to be laid so as to form a substantially even single layer.

Namely, since the first relative moving rate ratio and second relative moving rate ratio of the screw type adhesion inhibitor leveler 8 and screw type discharger 10, which are defined respectively by the equations (1) and (2) given above, are regulated to 10 to 30, the adhesion inhibitor Q neither is scattered by the screw blades 11*b* and 13*b* of the adhesion inhibitor leveler 8 and discharger 10 nor passes under these screw blades 11*b* and 13*b*. The agglomerate P can hence be laid so as to form an even single layer.

Example 3

Examples 3-1 to 3-4 and Comparative Examples 3-1 to 3-2

Next, agglomerate P was fed onto an adhesion inhibitor Q present on the hearth 5 and then leveled with the screw type agglomerate leveler 9, by using some different values of the outer diameter and lead angle θ of the screw blade 12*b* of the screw type agglomerate leveler 9, using different moving rates of the hearth 5, and changing the third relative moving rate ratio of the leveler 9, which is defined by the equation (3) given above. The results thereof are summarized in Table 3 under Example 3 (Examples 3-1 to 3-4 and Comparative Examples 3-1 to 3-2). In also this Example 3 (Examples 3-1 to 3-4 and Comparative Examples 3-1 to 3-2), the screw shaft 12*a* of the screw type agglomerate leveler 9 had a maximum amount of deflection δmax of 3 mm. The adhesion inhibitor Q laid on the hearth 5 had a flatness f1 of 6 mm or less in each case.

The results show the following. In Comparative Example 3-1, in which the third relative moving rate ratio was 1, the agglomerate P passed through the gap between the screw blade 12*b* of the screw type agglomerate leveler 9 and the hearth 5, and in the agglomerate P leveled thereon, local stacking occurred. In Comparative Example 3-2, in which the third relative moving rate ratio was 15, the agglomerate P was scattered by the screw blade 12*b*, and in the agglomerate P, local stacking occurred and areas where the particles were thinly laid occurred. It was hence impossible to lay the agglomerate P so as to form a single layer. In contrast, in each of Examples 3-1 to 3-4, in which the third relative moving rate ratios were in the range of 3 to 9, the agglomerate P was able to be laid so as to form a substantially single layer.

Namely, since the third relative moving rate ratio of the screw type agglomerate leveler 9, which is defined by the equation (3) given above, are regulated to 2 to 10, the agglomerate P neither is scattered by the screw blade 12*b* of the agglomerate leveler 9 nor passes under the screw blade 12*b*. The agglomerate P can hence be laid so as to form a substantially single layer.

TABLE 1

| | Unit | Example 1-1 | Example 1-2 | Comparative Example 1-1 |
|---|---|---|---|---|
| Particle diameter of agglomerate | mm | | 16 to 22 | |
| Local flatness of adhesion inhibitor (f1) | mm | 3 mm or less | 6 mm or less | 10 mm or less |
| (Local flatness of adhesion inhibitor)/(average particle diameter of agglomerate) ($f1/d_m$) | % | 14 to 19 | 27 to 38 | 45 to 63 |
| Leveling of agglomerate | | able to be laid so as to form even single layer | able to be laid so as to form substantially single layer | resulted in many areas where agglomerate was stacked |

TABLE 2

| | Unit | Example 2-1 | Example 2-2 | Example 2-3 | Example 2-4 | Comparative Example 2-1 | Comparative Example 2-2 |
|---|---|---|---|---|---|---|---|
| Particle diameter of adhesion inhibitor | — | 3 mm or less | 3 mm or less | 3 mm or less | 3 mm or less | 3 mm or less | 3 mm or less |
| Outer diameter of screw blade of adhesion inhibitor leveler and discharger | mm | 700 | 1,100 | 1,100 | 1,100 | 1,100 | 1,100 |
| Lead angle (θ) | degrees | 15.3 | 13.0 | 24.1 | 24.1 | 13.0 | 35.0 |
| Moving rate at hearth center | mm/s | 45.0 | 300.0 | 300.0 | 300.0 | 300.0 | 300.0 |
| First or second relative moving rate ratio (equation (1) or (2)) | — | 20 | 11 | 21 | 27 | 5 | 38 |
| Maximum amount of deflection of screw shaft of adhesion inhibitor leveler and discharger (δmax) | mm | 3 mm | 3 mm | 3 mm | 3 mm | 3 mm | 3 mm |
| Raising/lowering device | — | equipped | equipped | equipped | equipped | equipped | equipped |
| Scattering, passing through | | not occurred | not occurred | not occurred | not occurred | adhesion inhibitor passed through | adhesion inhibitor was scattered |
| Leveling of agglomerate | | able to be laid so as to form substantially single layer | able to be laid so as to form substantially single layer | able to be laid so as to form substantially single layer | able to be laid so as to form substantially single layer | passing of adhesion inhibitor through gap between screw blades resulted in local protrusions | scattering of adhesion inhibitor resulted in local stacking and areas where agglomerate was thinly laid |

TABLE 3

| | Unit | Example 3-1 | Example 3-2 | Example 3-3 | Example 3-4 | Comparative Example 3-1 | Comparative Example 3-2 |
|---|---|---|---|---|---|---|---|
| Particle diameter of agglomerate | mm | 16 to 22 | 16 to 22 | 16 to 22 | 16 to 22 | 16 to 22 | 16 to 22 |
| Local flatness of adhesion inhibitor (f1) | mm | 6 mm or less | 6 mm or less | 6 mm or less | 6 mm or less | 6 mm or less | 6 mm or less |
| Outer diameter of screw blade of agglomerate leveler | mm | 700 | 1,000 | 1,000 | 1,000 | 1,000 | 1,000 |
| Lead angle (θ) | degrees | 12.8 | 12.0 | 18.8 | 25.0 | 12.8 | 35.0 |
| Moving rate at hearth center | mm/s | 50 | 300 | 300 | 300 | 300 | 300 |
| Third relative moving rate ratio (equation (3)) | — | 5 | 3 | 5 | 9 | 1 | 15 |
| Maximum amount of deflection of screw shaft of agglomerate leveler (δmax) | mm | 3 mm | 3 mm | 3 mm | 3 mm | 3 mm | 3 mm |
| Raising/lowering device | — | equipped | equipped | equipped | equipped | equipped | equipped |
| Scattering, passing through | | not occurred | not occurred | not occurred | not occurred | agglomerate passed through | agglomerate was scattered |
| Leveling of agglomerate | | able to be laid so as to form substantially single layer | able to be laid so as to form substantially single layer | able to be laid so as to form substantially single layer | able to be laid so as to form substantially single layer | passing of agglomerate through gap between screw blades resulted in stacking, making it impossible to lay agglomerate so as to form single layer | scattering of agglomerate resulted in a decrease in spread density of agglomerate and local stacking, making it impossible to lay agglomerate so as to form single layer |

As described above, according to the method for producing granular metallic iron of the invention, after or at the same time as the granular metallic iron is discharged and before a fresh adhesion inhibitor is fed to the hearth, a surface layer of the used adhesion inhibitor adherent to the hearth is removed using the screw type discharger so that the residual used adhesion inhibitor remaining on the hearth has a flatness of 40% or less of the average particle diameter of the agglomerate. Consequently, the newly added adhesion inhibitor is not inhibited from being evenly leveled. Furthermore, when the granular metallic iron produced in the moving-bed type hearth reducing melting furnace is discharged, a reduction in the amount of granular metallic iron undischarged from the hearth is attained. As a result, accumulation of molten iron does not occur, and the production of the granular metallic iron is not inhibited.

While the invention has been described in detail and with reference to specific embodiments thereof, it will be apparent to one skilled in the art that various changes and modifications can be made therein without departing from the spirit and scope thereof.

This application is based on Japanese Patent Application No. 2010-192343 filed on Aug. 30, 2010, and the entire subject matter of which is incorporated herein by reference.

INDUSTRIAL APPLICABILITY

According to the invention, in the method for producing a granular metallic iron, which comprises leveling an adhesion inhibitor fed to the hearth of a moving-bed type hearth reducing melting furnace, feeding an agglomerate including an iron oxide-containing material and a carbonaceous reducing material onto the leveled adhesion inhibitor, leveling the agglomerate fed onto the adhesion inhibitor, subsequently heating the agglomerate to reduce and melt the iron oxide contained in the agglomerate to produce a granular metallic iron, and discharging the produced granular metallic iron using a screw type discharger, the adhesion inhibitor leveler, the agglomerate leveler, the discharger, and the physical state of materials present on the hearth are optimized to thereby enable the agglomerate to be spread in a single layer, and the agglomerate hence is evenly heat-treated to enable high-quality granular metallic iron to be produced in satisfactory yield.

REFERENCE SIGNS LIST

P: Agglomerate (feed material for granular metallic iron)
P1: Granular metallic iron
Q: Adhesion inhibitor
Q1: Used adhesion inhibitor
Qf: Average surface of leveled adhesion inhibitor
f1: Flatness of adhesion inhibitor
S: Gap
θ: Lead angle
δmax: Maximum amount of deflection
1: Rotary-hearth furnace
2: Outer circumferential wall
3: Inner circumferential wall
4: Ceiling part
5: Rotary hearth
6: Adhesion inhibitor feeder
7: Agglomerate feeder
6*a*, 7*a*: Belt conveyor
6*b*, 7*b*: Receiving hopper
8: Screw type adhesion inhibitor leveler
9: Screw type agglomerate leveler
10: Screw type discharger
11, 12, 13: Screw
11*a*, 12*a*, 13*a*: Screw shaft
11*b*, 12*b*, 13*b*: Screw blade
13*b*-1: Divided blade
14: Bearing
15*a*: Bolt
15*b*: Nut
16: Lug
17: Electric cylinder for shaft raising/lowering

The invention claimed is:

1. A method for producing a granular metallic iron, which comprises:

leveling an adhesion inhibitor fed to a hearth of a reducing melting furnace having a hearth with a moving-bed;

feeding an agglomerate including particles of an iron oxide-containing material and a carbonaceous reducing material onto the leveled adhesion inhibitor;

leveling the agglomerate fed onto the adhesion inhibitor;

subsequently heating the agglomerate to reduce and melt the iron oxide contained in the agglomerate to produce a granular metallic iron; and discharging the produced granular metallic iron using a discharger comprising a screw, wherein the adhesion inhibitor fed to the hearth is evenly leveled using an adhesion inhibitor leveler comprising a screw so that the leveled adhesion inhibitor has a flatness of 40% or less of an average particle diameter of the agglomerate, and wherein the agglomerate fed onto the adhesion inhibitor is evenly laid using an agglomerate leveler comprising a screw, so that the agglomerate forms a single layer of the particles, wherein after or at the same time as the granular metallic iron is discharged and before a fresh adhesion inhibitor is fed to the hearth, a surface layer of the used adhesion inhibitor remaining on the hearth is removed using the discharger comprising a screw so that a residual used adhesion inhibitor remaining on the hearth has a flatness of 40% or less of the average particle diameter of the agglomerate.

2. A method for producing a granular metallic iron, which comprises:

leveling an adhesion inhibitor fed to a hearth of a reducing melting furnace having a hearth with a moving-bed;

feeding an agglomerate including particles of an iron oxide-containing material and a carbonaceous reducing material onto the leveled adhesion inhibitor;

leveling the agglomerate fed onto the adhesion inhibitor;

subsequently heating the agglomerate to reduce and melt the iron oxide contained in the agglomerate to produce a granular metallic iron; and discharging the produced granular metallic iron using a discharger comprising a screw, wherein the adhesion inhibitor fed to the hearth is evenly leveled using an adhesion inhibitor leveler comprising a screw so that the leveled adhesion inhibitor has a flatness of 40% or less of an average particle diameter of the agglomerate, and wherein the agglomerate fed onto the adhesion inhibitor is evenly laid using an agglomerate leveler comprising a screw, so that the agglomerate forms a single layer of the particles, wherein the adhesion inhibitor leveler comprising a screw has a first relative moving rate ratio defined by the following equation (1) and the discharger comprising a screw has a second relative moving rate ratio defined by the following equation (2), at least one of the first relative moving rate ratio and second relative moving rate ratio being 10 to 30:

First relative moving rate ratio=(outer diameter (mm) of screw of adhesion inhibitor leveler comprising a screw)×tan(lead angle (degrees))×(number of threads)×(screw rotation speed (r/m))×π/60/(moving rate at hearth center (mm/s)) (1), Second relative moving rate ratio=(outer diameter (mm) of screw of discharger comprising a screw)×tan(lead angle (degrees))×(number of threads)×(screw rotation speed (r/m))×π/60/(moving rate at hearth center (mm/s)) (2).

3. A method for producing a granular metallic iron, which comprises:

leveling an adhesion inhibitor fed to a hearth of a reducing melting furnace having a hearth with a moving-bed;

feeding an agglomerate including particles of an iron oxide-containing material and a carbonaceous reducing material onto the leveled adhesion inhibitor;

leveling the agglomerate fed onto the adhesion inhibitor;

subsequently heating the agglomerate to reduce and melt the iron oxide contained in the agglomerate to produce a granular metallic iron; and discharging the produced granular metallic iron using a discharger comprising a screw, wherein the adhesion inhibitor fed to the hearth is evenly leveled using an adhesion inhibitor leveler comprising a screw so that the leveled adhesion inhibitor has a flatness of 40% or less of an average particle diameter of the agglomerate, and wherein the agglomerate fed onto the adhesion inhibitor is evenly laid using an agglomerate leveler comprising a screw, so that the agglomerate forms a single layer of the particles, wherein the agglomerate leveler comprising a screw has a third relative moving rate ratio defined by the following equation (3), the third relative moving rate ratio being 2 to 10:

Third relative moving rate ratio=(outer diameter (mm) of screw of agglomerate leveler comprising a screw)×tan(lead angle (degrees))×(number of threads)×(screw rotation speed (r/m))×π/60/(moving rate at hearth center (mm/s)) (3).

* * * * *